US011573046B2

(12) United States Patent
Lee et al.

(10) Patent No.: US 11,573,046 B2
(45) **Date of Patent: *Feb. 7, 2023**

(54) REFRIGERATOR

(71) Applicant: LG ELECTRONICS INC., Seoul (KR)

(72) Inventors: Sunghun Lee, Seoul (KR); Yoonseong Nam, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 727 days.

This patent is subject to a terminal disclaimer.

(21) Appl. No.: 16/523,813

(22) Filed: Jul. 26, 2019

(65) Prior Publication Data

US 2019/0346194 A1 Nov. 14, 2019

Related U.S. Application Data

(63) Continuation of application No. 15/247,581, filed on Aug. 25, 2016, now Pat. No. 10,378,811.

(30) Foreign Application Priority Data

Sep. 17, 2015 (KR) ..... 10-2015-0131806

(51) Int. Cl.
*F25D 17/04* (2006.01)
*F25D 11/02* (2006.01)
(Continued)

(52) U.S. Cl.
CPC ..... *F25D 17/045* (2013.01); *F25D 11/02* (2013.01); *F25D 17/065* (2013.01); *F25D 25/025* (2013.01); *F25D 2317/061* (2013.01)

(58) Field of Classification Search
CPC ..... F25D 17/045; F25D 17/04; F25D 17/065; F25D 11/02; F25D 25/025; F25D 2317/061
See application file for complete search history.

(56) References Cited

U.S. PATENT DOCUMENTS 1,943,646 A 1/1934 Warren ..... F25D 25/024 62/266
2,255,503 A 9/1941 Carbary ..... B65D 81/24 454/183

(Continued)

FOREIGN PATENT DOCUMENTS

CN 2589904 Y 12/2003
CN 201215429 Y 4/2009

(Continued)

*Primary Examiner* — Andrew M Roersma
(74) *Attorney, Agent, or Firm* — Dentons US LLP

(57) ABSTRACT

A refrigerator including a refrigerator main body having a refrigerating chamber therein, a cold air passage duct disposed within the refrigerator main body and provided with a cold air passage therein to discharge the cold air into the refrigerating chamber, a control case coupled to one surface of the cold air discharge duct and having a cold air discharge opening through which the cold air is discharged, and a shutter disposed between the cold air passage duct and the control case, and reciprocally movable in one direction to open and close at least part of the cold air discharge opening, and a knob link rotatably connected to the cold air passage duct to press the shutter such that the shutter is reciprocally movable.

15 Claims, 13 Drawing Sheets

(51) Int. Cl.
*F25D 17/06* (2006.01)
*F25D 25/02* (2006.01)

(56) References Cited

U.S. PATENT DOCUMENTS 3,866,437 A 2/1975 Spencer
4,732,014 A * 3/1988 Frohbieter ..... F25D 17/04 62/382
4,850,206 A 7/1989 Larsen ..... F25D 17/04 62/382
5,172,566 A 12/1992 Jung ..... F25D 17/045 236/78 C
5,375,413 A 12/1994 Fredell ..... F24F 13/12 137/625.33
5,884,496 A 3/1999 Kim ..... F24F 13/06 62/186
5,901,562 A 5/1999 Tunzi et al.
6,044,659 A * 4/2000 Ji ..... F25D 17/045 62/186
6,069,466 A 5/2000 Noritake ..... F16K 1/18 318/282
6,073,458 A 6/2000 Kim ..... F24F 13/12 454/195
6,330,891 B1 12/2001 Noritake ..... F16K 1/18 137/595
6,957,549 B2 * 10/2005 Kim ..... F25D 17/045 62/406
7,856,844 B2 * 12/2010 Kim ..... F25D 17/065 62/415
10,378,811 B2 * 8/2019 Lee ..... F25D 17/065

FOREIGN PATENT DOCUMENTS

CN 201251338 Y 6/2009
CN 204141928 U 2/2015
ES 2429392 A1 11/2013
FR 1390823 A * 2/1965 ..... F25D 17/045
FR 1516655 3/1968
JP 63-123971 A 5/1988
JP 1-203876 A 8/1989
KR 1990-0005682 B1 8/1990
KR 10-0232829 B1 12/1999
KR 10-2010-0107168 A 10/2010

* cited by examiner

REFRIGERATOR

CROSS-REFERENCE TO RELATED APPLICATION

This application is a Continuation of U.S. patent application Ser. No. 15/247,581, filed Aug. 25, 2016, now allowed, which claims priority under 35 U.S.C. § 119 and 35 U.S.C. § 365 to Korean Patent Application No. 10-2015-0131806, filed on Sep. 17, 2015, whose entire disclosure is hereby incorporated by reference.

BACKGROUND

1. Field of the Invention

A refrigerator having a structure capable of adjusting a flow rate of cold air supplied into a refrigerator main body by a user's manual operation.

2. Background

In general, a refrigerator keeps foods such as meat, fish, vegetables, fruits, beverages and the like in a fresh state. A conventional refrigerator includes a refrigerator main body having storage spaces such as a freezing chamber, a refrigerating chamber, vegetable chambers, and the like, a refrigerating cycle device provided in the refrigerator main body, and a door mounted to one side of the refrigerator main body to open and close the storage spaces.

The refrigerating cycle device of the refrigerator is activated when temperature of the freezing chamber or the refrigerating chamber is more than a preset temperature. In response to the activation of the refrigerating cycle device, cold air is generated in an evaporator and then circulates along the storage spaces. While the cold air circulates along the storage spaces, the storage spaces are maintained at preset temperatures.

Refrigerators are classified into various types according to a method of circulating cold air, locations of a freezing chamber and a refrigerating chamber, and a configuration of an evaporator.

As one example, refrigerators may include a refrigerator having a freezing chamber located above a refrigerating chamber, a refrigerator having a freezing chamber and a refrigerating chamber located side by side, a refrigerator having a freezing chamber located below a refrigerating chamber, and the like.

A chiller chamber may be formed at the lowermost portion of the refrigerating chamber. The chiller chamber may include a chiller chamber drawer, and a chiller chamber cover forming an upper surface of the chiller chamber drawer. The chiller chamber may keep meat and the like. The chiller chamber is preferably maintained at a relatively low temperature close to 0° C. To this end, a duct with a cold air passage is installed at a rear side of the chiller chamber so as to supply cold air into the chiller chamber. The amount of cold air should be adjusted according to an amount of meat kept in the chiller chamber or an external temperature.

A conventional refrigerator includes a damper or an insulating member installed in the duct, along which the cold air flows, to adjust the amount of cold air supplied into the refrigerating chamber. However, the damper or the insulating material are not manually controlled by a user, but automatically controlled in an electric manner. Moreover, the amount of cold air was controlled by electrically adjusting an opening and closing amount of the damper, which made it impossible to adjust the amount of cold air supplied into the refrigerating chamber according to a user's need. Additionally, cold air supplied to the refrigerating chamber along the duct was not uniformly supplied through a cold air discharge opening.

Furthermore, the electric control of the amount of cold air resulted in increased power consumption, as well as increased material costs due to the installation of the damper and electric components for controlling the damper. Also, for conventional structures in which the user is able to manually adjust a cold air discharge opening for supplying cold air from a rear side of a drawer of a refrigerating chamber, the drawer must be detached in order to adjust the cold air discharge opening.

SUMMARY OF THE INVENTION

The present disclosure is directed to providing a structure for adjusting a flow rate of cold air supplied into a refrigerating chamber according to a user's request in a manner of installing a knob, which is manually manipulated by a user.

The present disclosure is also directed to providing a cold air flow rate adjustment structure, capable of reducing power consumption and material costs and implementing a user-desired temperature.

Additionally, the present disclosure is directed to providing a structure capable of uniformly supplying cold air through a cold air discharge opening while supplying the cold air into a refrigerating chamber through the cold air discharge opening.

Additionally, the present disclosure is directed to providing a cold air flow rate adjustment structure, capable of adjusting an opening and closing amount (level or amount) of a cold air discharge opening without detaching a drawer.

To achieve these and other advantages and in accordance with the purpose of this specification, as embodied and broadly described herein, there is provided a refrigerator including a main body having a refrigerating chamber therein, a cold air passage duct disposed within the main body, the cold air passage duct including a cold air passage to discharge cold air into the refrigerating chamber, a control case attached at one surface of the cold air discharge duct, the control case including a cold air discharge opening through which the cold air is discharged, a shutter provided between the cold air passage duct and the control case, the shutter being reciprocally movable in one direction to open and close at least a part of the cold air discharge opening, and a knob link rotatably connected to the cold air passage duct to press against the shutter such that the shutter is reciprocally movable, wherein the knob link includes a link body having a rotation shaft, the link body being connected to the cold air passage duct by the rotation shaft to be reciprocally rotatable by a predetermined distance, a pressing portion provided at a first end portion of the link body that is accommodated in a part of the shutter, the pressing portion to press against the shutter to be reciprocally movable in the one direction, and a knob formed on a second end portion of the link body opposite to the first end portion, whereby at least a portion of the knob is externally exposed through the control case to be manipulated by a user.

According to an aspect of the present disclosure, the link body includes a slot formed through a first end portion thereof that extends in an upward and downward direction relative to the ground surface.

According to an aspect of the present disclosure, the knob includes a sliding plate slidably coupled to the cold air passage duct, and a knob handle protruding from the sliding plate and inserted into the slot, whereby at least a portion of the knob handle is externally exposed through the cut window.

According to an aspect of the present disclosure, the cold air passage duct includes a dividing portion that divides the cold air discharge opening into a first side and a second side, wherein the dividing portion extends from upper to lower portions of the cold air discharge opening between the first and second sides of the cold air discharge opening.

According to an aspect of the present disclosure, the shutter includes a communicating portion, the communicating portion being a cut-off portion formed at an upper side of the shutter that communicates with the cold air discharge opening such that at least part of one of the first and second sides of the cold air discharge opening is open to discharge cold air.

According to an aspect of the present disclosure, the first and second sides of the cold air discharge opening each discharge the cold air therethrough such that the first side of the cold air discharge opening is open while the second side of the cold air discharge opening is open in response to at least part of the second side of the cold air discharge opening being in communication with the communicating portion.

According to an aspect of the present disclosure, the link body is shaped having a width that decreases toward both end portions of the link body near the rotation shaft and rotates to enable the reciprocal movement of the shutter. According to another aspect of the present disclosure, the link body is formed in a shape of a diamond extending toward the first end of the link body to increase a rotating distance of the link body.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention. In the drawings.

DETAILED DESCRIPTION OF THE INVENTION

Hereinafter, exemplary embodiments of the present disclosure invention will be described in detail with reference to the accompanying drawings. It is understood that the description herein is not intended to limit the claims to the specific embodiments described. On the contrary, it is intended to cover alternatives, modifications, and equivalents as may be included within the spirit and scope of the present disclosure.

In general, a suffix such as "module" and "unit" may be used to refer to elements or components. Use of such a suffix herein is merely intended to facilitate description of the specification, and the suffix itself is not intended to give any special meaning or function. In describing the present disclosure, moreover, the detailed description will be omitted when a specific description for publicly known technologies to which the invention pertains is judged to obscure the gist of the present disclosure. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of features, numbers, steps, functions, several components, or combinations thereof, disclosed in the specification, and it is also understood that greater or fewer features, numbers, steps, functions, several components, or combinations thereof may likewise be utilized.

Figure 1A:
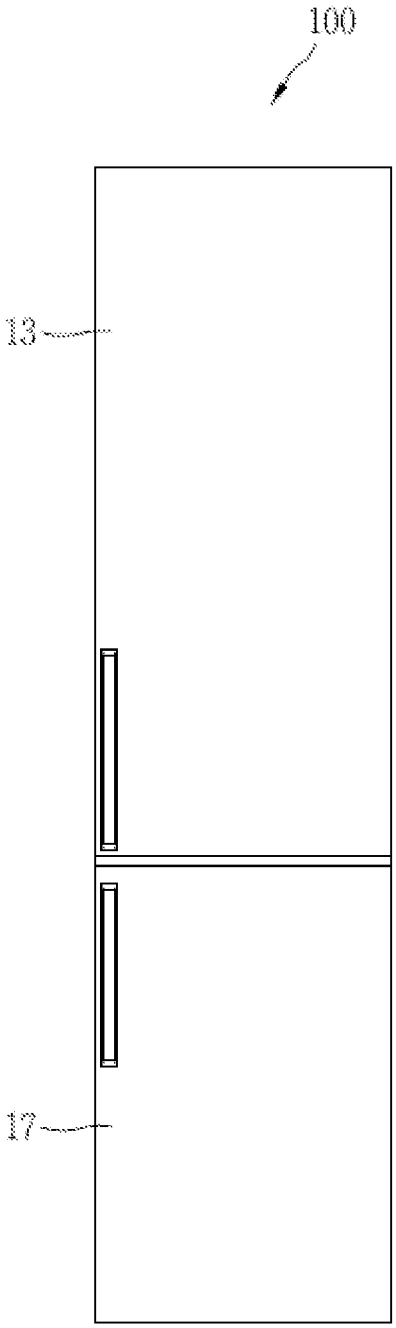
FIG. 1A is a conceptual view illustrating an interior of a refrigerator in accordance with the present disclosure.
Figure 1B:
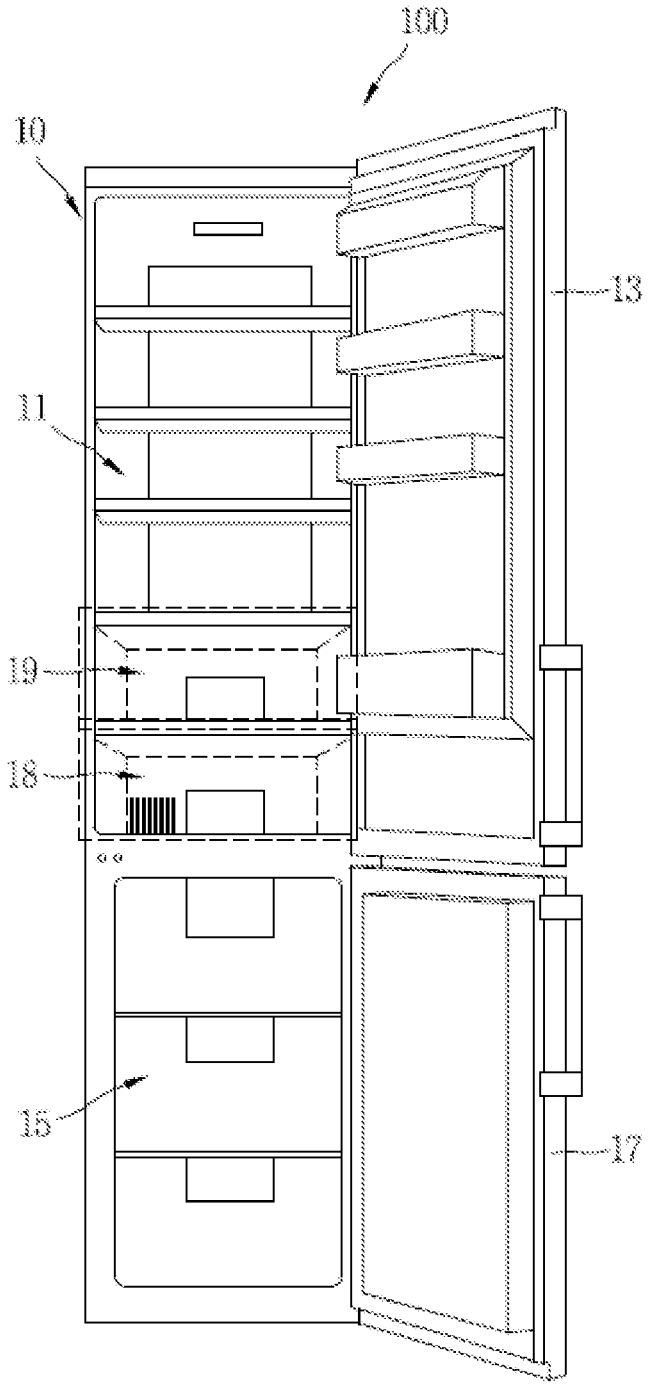
FIG. 1B is a view of the refrigerator illustrated in FIG. 1A with the refrigerating chamber door and the freezing chamber door open to illustrate an interior of the refrigerator in accordance with the present disclosure.
Figure 2:
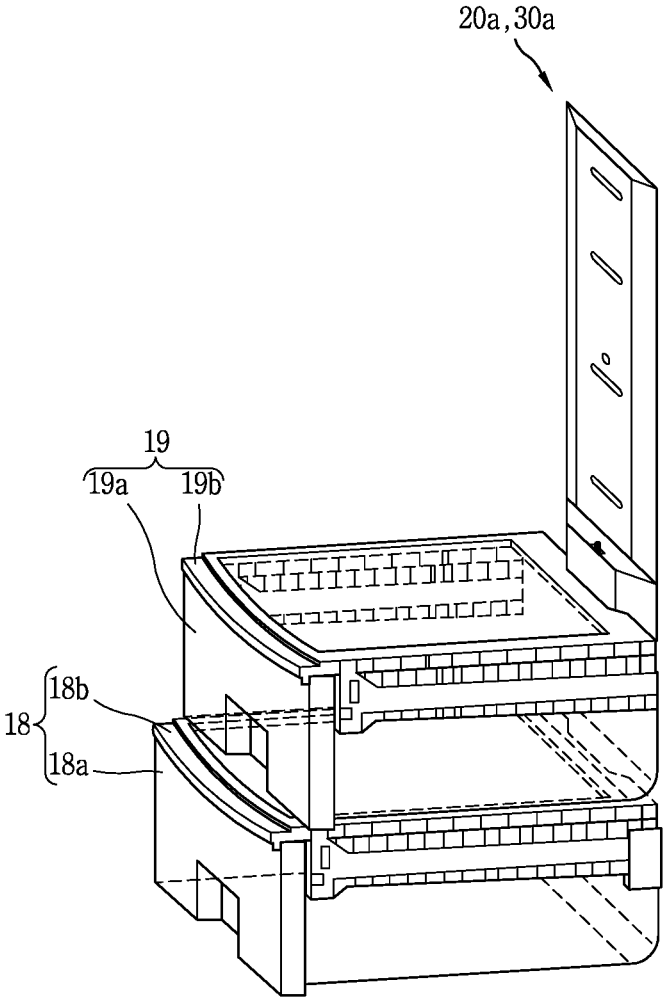
FIG. 2 is a perspective view of the refrigerator of FIGS. 1A and 1B.
Figure 3:
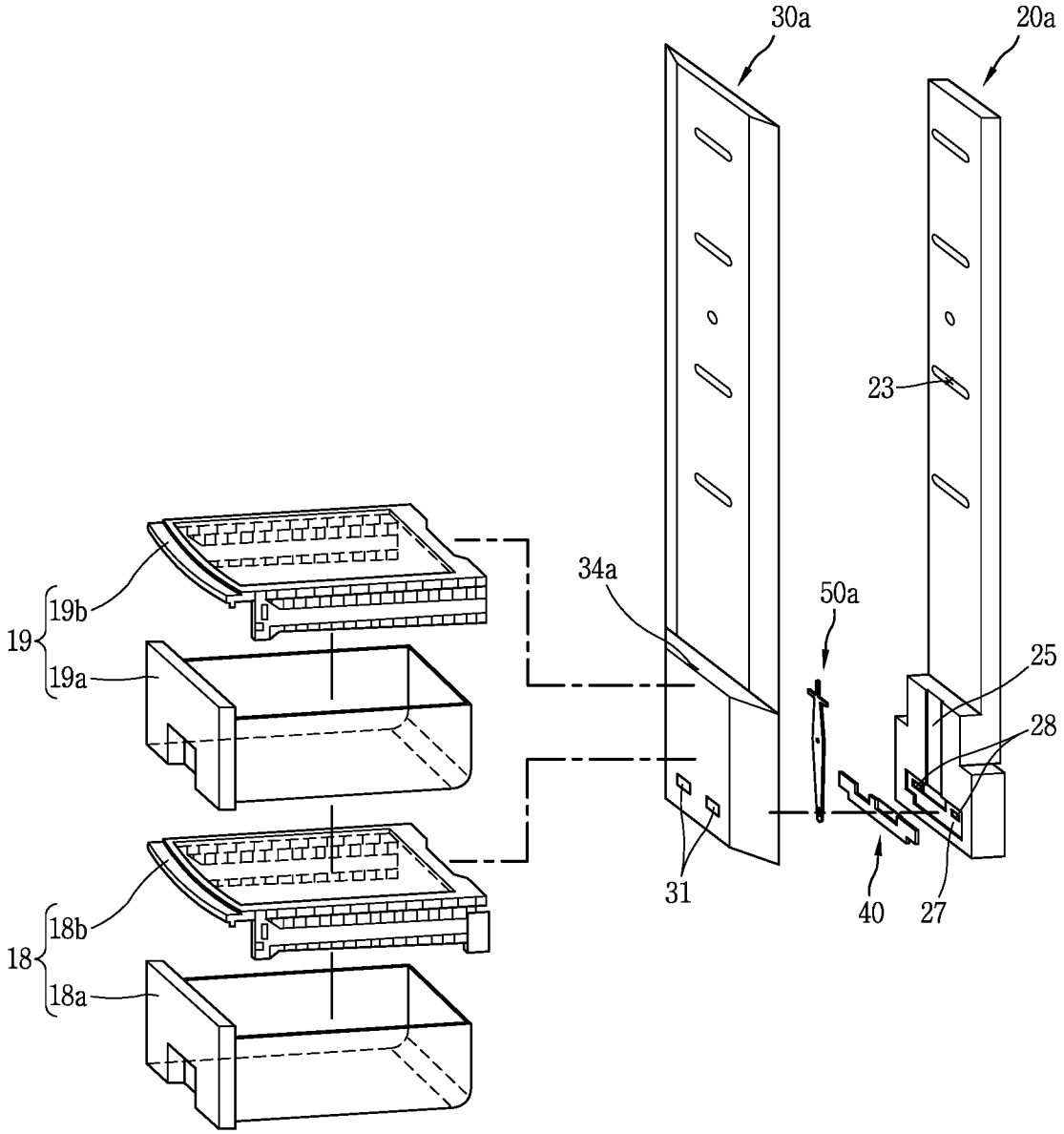
FIG. 3 is a disassembled perspective view of the refrigerator illustrated in FIGS. 1A and 1B.

FIG. 1A is a conceptual view illustrating an exterior of a refrigerator in accordance with an embodiment of the present disclosure. FIG. 1B is a view of the refrigerator illustrated in FIG. 1A with the refrigerating chamber door and the freezing chamber door open to illustrate an interior of the refrigerator. FIG. 2 is a perspective view of a structure related to the refrigerator of FIGS. 1A and 1B. FIG. 3 is a disassembled perspective view illustrating the structure related to the refrigerator illustrated in FIGS. 1A and 1B.

Hereinafter, an overall configuration of a refrigerator according to an embodiment of the present disclosure will be described with reference to FIGS. 1A, 1B, 2, and 3.

A refrigerator disclosed herein may include a refrigerator main body 10, a cold air passage duct 20*a*, a control case 30*a*, a shutter 40, and a knob link 50*a*.

The refrigerator main body 10 may accommodate a refrigerating chamber 11 and a freezing chamber 15. For example, the refrigerator disclosed herein may be a bottom freezer type refrigerator. FIG. 1 illustrates the bottom freezer type refrigerator 100. In the bottom freezer type refrigerator 100, a lower space is configured as the freezing chamber 16 and an upper space relative to the lower space is configured as the refrigerating chamber 11. A freezing chamber door 17 for opening and closing the freezing chamber 15 and a refrigerating chamber door 13 for opening and closing the refrigerating chamber 11 may be attached to the refrigerator main body 10.

The present disclosure is preferably applied to the bottom freezer type refrigerator, but not limited thereto. It is understood that the present disclosure may be applied to various types of refrigerators by adjusting an arrangement of the knob 40, a cold air discharge opening 31, and the like, which is explained in more detail below.

Specifically, in the structure disclosed herein, a chiller chamber drawer 18*a* may be attached to the lowermost end of the refrigerating chamber 11, and a chiller chamber cover 18*b* that forms an upper surface of a chiller chamber 18 may be attached to an upper portion of the chiller chamber drawer 18*a*. Together, the chiller chamber drawer 18*a* and the chiller chamber cover 18*b* may be referred to as the chiller chamber 18. The chiller chamber 18 may store meat, and the like, and is preferably maintained at a relatively low temperature close to 0° C.

An introduction of cold air into the chiller chamber drawer 18*a* disposed at the lowermost end of the refrigerating chamber 11 should be allowed. A cold air passage duct 20*a* and the control case 30 may be provided at an upper portion of a rear surface of the chiller chamber drawer 18*a* and configured to communicate with the cold air discharge opening 31.

Another drawer may further be provided on a shelf of the refrigerating chamber. The another drawer may be provide directly above a shelf with the chiller chamber drawer 18*a*. The another drawer, for example, may be a vegetable chamber drawer 19*a*. The vegetable chamber drawer 19*a*, similar to the chiller chamber drawer 18*a*, may include a vegetable chamber cover 19*b* that forms an upper surface of a vegetable chamber 19. The vegetable chamber 19 may be formed by coupling the vegetable chamber drawer 19*a* and the vegetable chamber cover 19*b* to each other.

In order to adjust a flow rate of cold air discharged through the cold air discharge opening 31 (explained in more detail below), an opening and closing amount of the cold air discharge opening 31 may be adjusted. However, because the cold air discharge opening 31 is obscured by the chiller chamber drawer 18*a* and the vegetable chamber drawer 19*a*, the user cannot directly adjust the opening and closing amount of the cold air discharge opening 31. In order for the user to adjust the opening and closing amount of the cold air discharge opening 31, the chiller chamber drawer 18*a* and the vegetable chamber drawer 19*a* should be detached. However, the present invention may employ a knob link 50*a* (explained in more detail below), to enable the adjustment of the opening and closing amount of the cold air discharge opening 31 without detaching the chiller chamber drawer 18*a* and the vegetable chamber drawer 19*a*.

The cold air passage duct 20*a* may be installed within the refrigerator main body 10. The cold air passage duct 20*a* may include a cold air passage 23. As illustrated in FIGS. 1, 2, and 3, the cold air passage duct 20*a* may be provided at a rear wall side of the refrigerating chamber 11 within the refrigerator main body to allow cold air to be discharged into the refrigerating chamber 11.

Cold air generated in an evaporator may flow along the cold air passage 23 of the cold air passage duct 20*a*. In the cold air passage duct 20*a* of the present disclosure, similar to a conventional refrigerator, a refrigerating cycle is provided to supply cold air in response to a status change of a refrigerant. Components of the refrigerating cycle, such as an evaporator, a compressor, a condenser and an expansion valve, are components applied to a refrigerating cycle of a conventional refrigerator, so for convenience purposes a detailed description thereof is omitted.

The control case 30*a* may be installed at one surface of the cold air passage duct 20*a*. The control case 30*a* may be provided with the cold air discharge opening 31 through which cold air within the cold air passage duct 20*a* is discharged. The control case 30*a* may be understood as a plate structure coupled to one surface of the cold air passage duct 20*a*. For example, as illustrated in FIG. 3, the cold air passage duct 20*a* may be coupled to a front surface of the cold air passage duct 20*a*.

Figure 4:
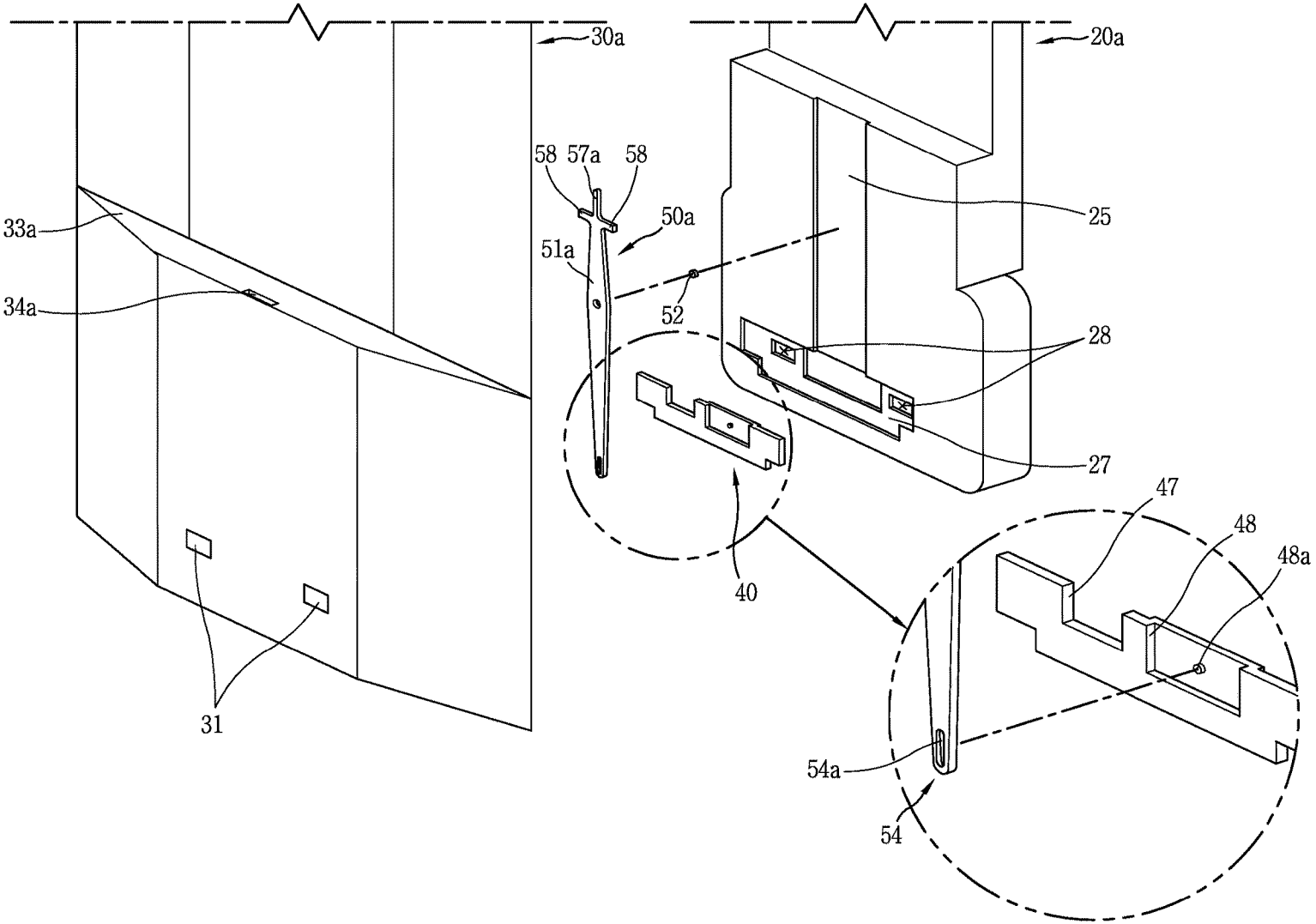
FIG. 4 is a disassembled perspective view illustrating a cold air flow rate adjustment structure, including a knob link in accordance with a first embodiment of the present disclosure.

The control case 30*a* may be bent in one direction above the cold air discharge opening 31 and bent in another direction different from the one direction. Accordingly, a bent surface 33*a* may be provided on the control case 30*a*. For example, as illustrated in FIG. 4, the bent surface 33*a* may be formed above the cold air discharge opening 31. A cut portion 34*a* may be formed by cutting off a part of the bent surface 33*a*. A knob 57*a* may be externally exposed through the cut portion 34*a*, which enables the user to manipulate the knob 57*a*.

The bent surface 33*a* may be formed at a position above an installation position of the vegetable chamber drawer 19*a*. The knob 57*a* (explained in more detail below) may be formed near or above the bent surface 33*a*, and thus the user does not have to detach the vegetable chamber drawer 19*a* or the vegetable chamber drawer 18*a* to adjust the opening and closing amount of the cold air discharge opening 31.

Figure 7:
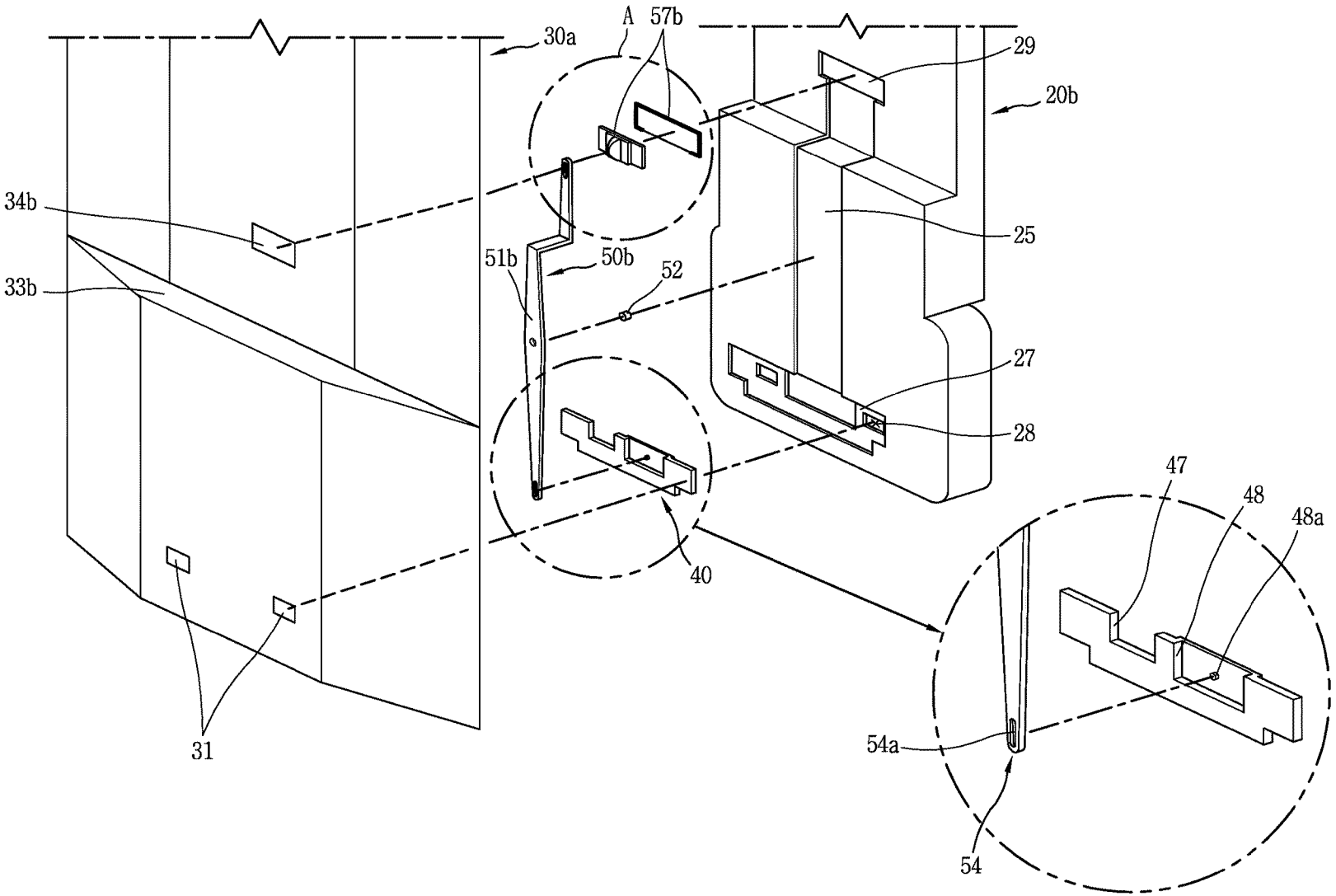
FIG. 7 is a disassembled perspective view illustrating a cold air flow rate adjustment structure, including a structure of a knob link in accordance with a second embodiment of the present disclosure.

The control case 30*a* may include a cut window 34*b* (see e.g., FIG. 7). The cut window 34*b* may be formed above the bent surface 33*a* of the control case 30*a* and be spaced apart from the bent surface 33*a* by a predetermined distance. The cut window 34*b* is a window for manipulating a knob link

50*b* according to a second embodiment, which will be described in more detail below together with the knob link 50*b* according to the second embodiment with reference to FIGS. 7 and 8.

The cold air passage duct 20*a* may be bent two times so that it is parallel to the control case 30*a*. Such configuration allows the control case 30*a* to be coupled to one surface of the cold air passage duct 20*a*. The knob link 50*a* may also be bent two times to correspond to the control case 30*a* and the cold air passage duct 20*a*.

The cold air passage duct 20*a* may be provided with a shutter accommodating portion 27 to accommodate a shutter 40 in a manner of allowing a reciprocal movement of the shutter 40. The shutter accommodating portion 27 may be greater than the shutter 40, considering the coupling with the reciprocally-movable shutter 40. The shutter accommodating portion 27 may be provided with a cold air communication outlet 28 which communicates with the cold air discharge opening 31 of the control case 30*a* (explained in more detail below) and the cold air passage 23 within the cold air passage duct 20*a*.

The cold air passage duct 20*a* may be provided with a link accommodating portion 25 for accommodating the knob link 50*a* in a manner of allowing the knob link 50*a* to be reciprocally rotatable. The knob link 50*a* may be connected to the link accommodating portion 25 by a rotation shaft 52 to be reciprocally rotatable by a predetermined distance.

A detailed structure of the control case 30*a* related to the present disclosure will be described below in more detail together with the shutter 40, with reference to the embodiment illustrated in FIG. 5.

FIG. 4 is a disassembled perspective view illustrating a cold air flow rate adjustment structure, including a knob link 50*a* in accordance with a first embodiment of the present disclosure.

A structure of the knob link 50*a* according to the first embodiment of the present disclosure will be described with reference to FIG. 4.

The knob link 50*a* may be rotatably connected to the cold air passage duct 20*a* and press against the shutter 40 to be reciprocally movable. The knob link 50*a* may include a link body 51*a*, a pressing portion 54, and a knob 57*a*.

The present disclosure provides knob links 50*a*, 50*b* according to the first and the second disclosed embodiments. Hereinafter, the knob link 50*a* according to the first embodiment is described with reference to FIG. 4. The knob link 50*b* according to the second embodiment is described in more detail below with reference to FIGS. 7, 8, 9A, 9B and 9C.

As illustrated in FIG. 4, a link body 51*a* may be provided with the rotation shaft 52, and connected to the cold air passage duct 20*a* by the rotation shaft 52 to be reciprocally rotatable by a predetermined distance. The pressing portion 54 may be provided at one end portion of the link body 51*a*, and the knob 57*a* may be provided at another end portion opposite to the one end portion with the pressing portion 54.

The link body 51*a* may be disposed in a space of at least part of the cold air passage duct 20*a* in a manner of extending with intersecting with one direction that the shutter 40 reciprocally moves. Referring to FIG. 4, the link body 51*a* may be disposed in an upward and downward direction relative to the ground surface. As the link body 51*a* reciprocally rotates centering on the rotation shaft 52, the shutter 40 is able to reciprocally move in a left and right direction.

The link body 51*a* may be formed with a width decreasing from a portion near the rotation shaft 52 to both end portions (e.g., narrowing width). For example, as illustrated in FIG. 4, the link body 51*a* may be formed in a shape of a diamond toward a lower side. This structure increases a rotating distance of the link body 151*a* that rotates centering on the rotation shaft 52 and thus is more advantageous in the reciprocal movement of the shutter 40. However, it is understood that the link body 51*a* may have different shapes according to the first and second embodiments of the knob link. The link body 51*a* according to the first embodiment may extend up to a position near the bent surface 33*a*.

The knob 57*a* may upwardly protrude from an upper portion of the link body 51*a*. FIG. 4 illustrates an example in which the knob 57*a* protrudes with a thickness thinner than the width of the link body 51*a*. The knob 57*a* may be exposed through the cut portion 34*a* of the control case 30*a* so that it can be manipulated by the user.

Also, movement limit protrusions 58 may be formed on an upper portion of the link body 51*a* in an intersecting direction with the protruding direction of the knob 57*a*. FIG. 4 illustrates an example in which the movement limit protrusions 58 protrude to left and right sides, respectively, from an end portion of the link body 51*a* with the knob 57*a*. As illustrated, the movement limit protrusions 58 may be formed in a similar shape to the knob 57*a*, though having a different width.

Figure 6A:
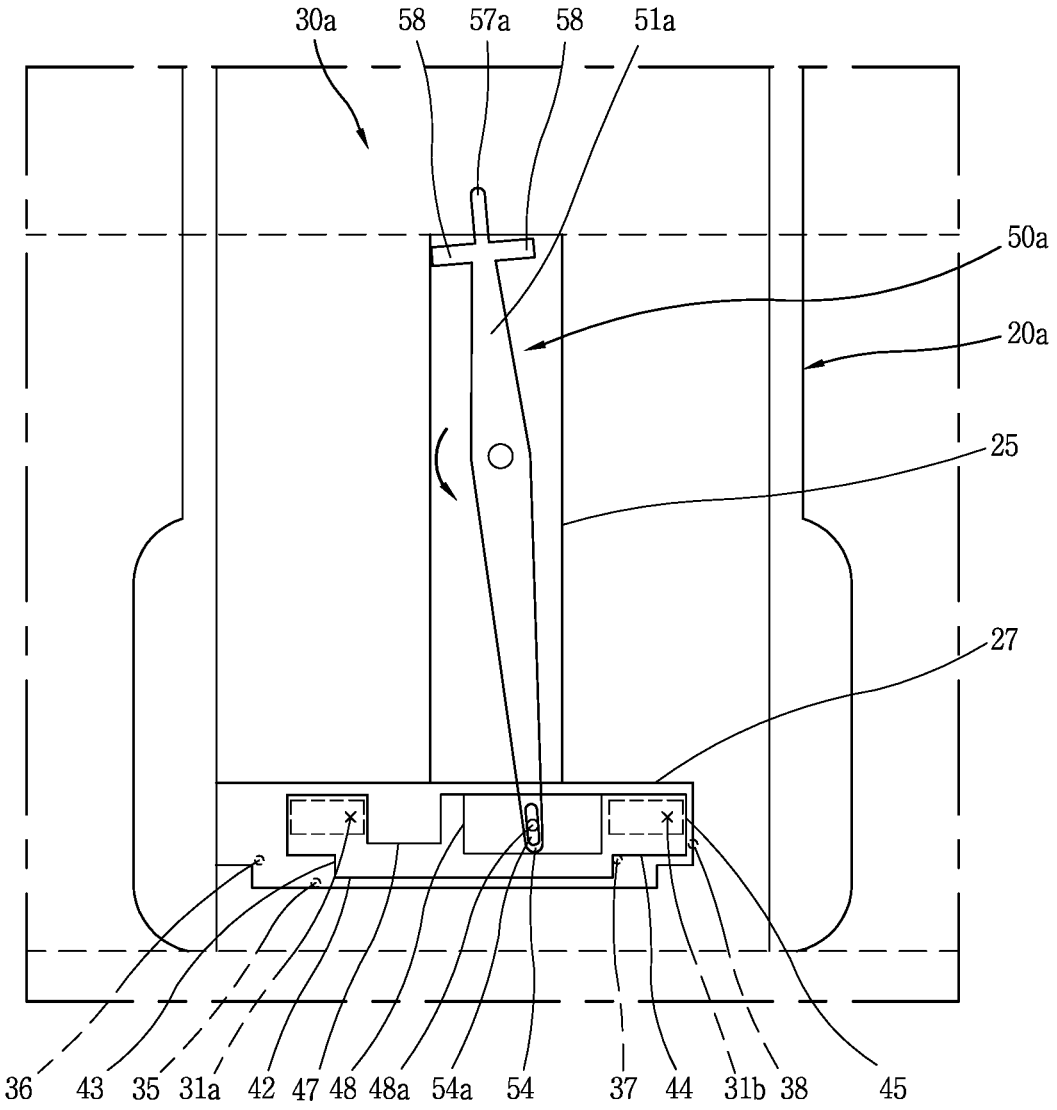
FIG. 6A is a conceptual view illustrating an operation that the cold air discharge opening is closed by the knob link according to the first embodiment of the present disclosure.
Figure 6B:
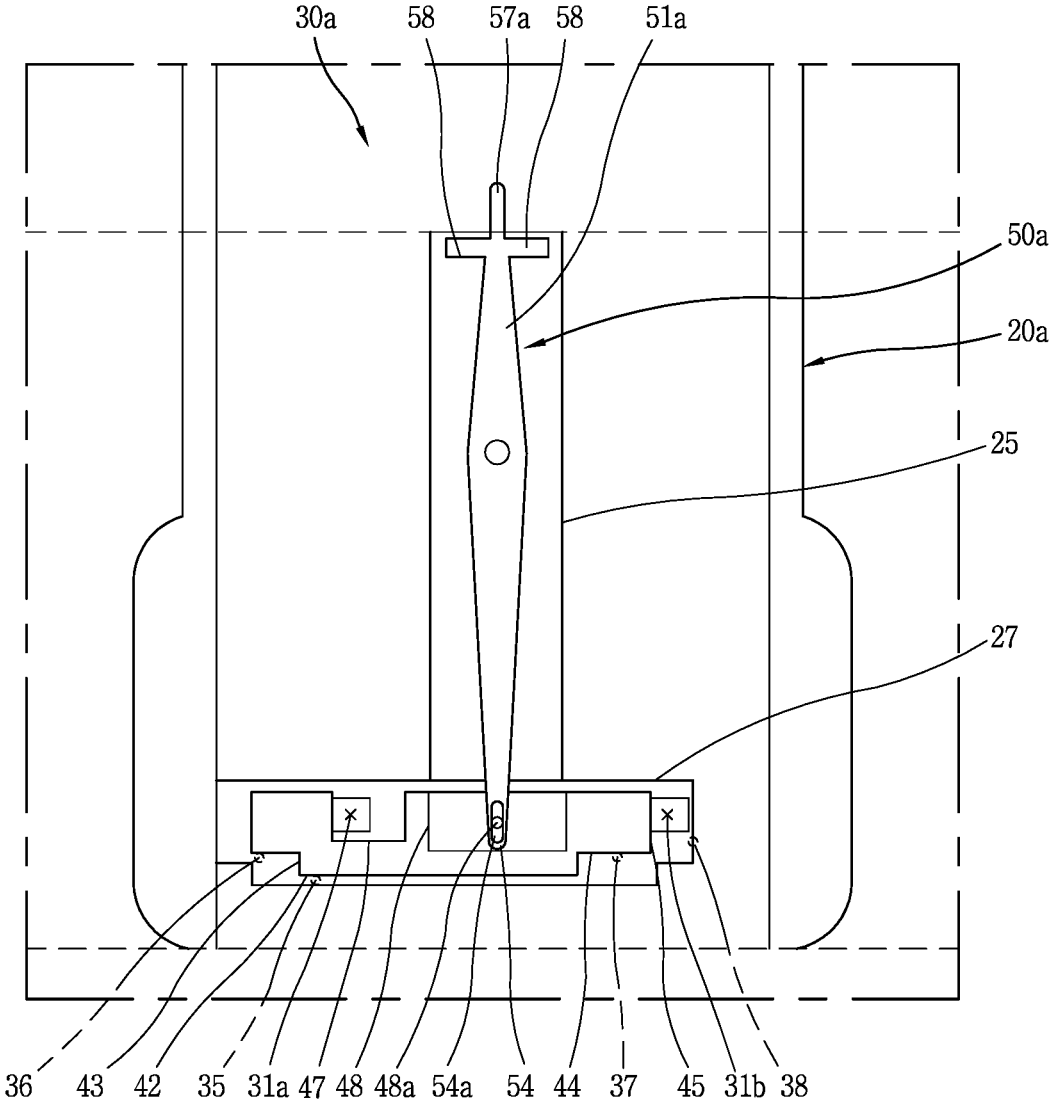
FIG. 6B is a conceptual view illustrating an operation that the cold air discharge opening is open by half by the knob link according to the first embodiment of the present disclosure.
Figure 6C:
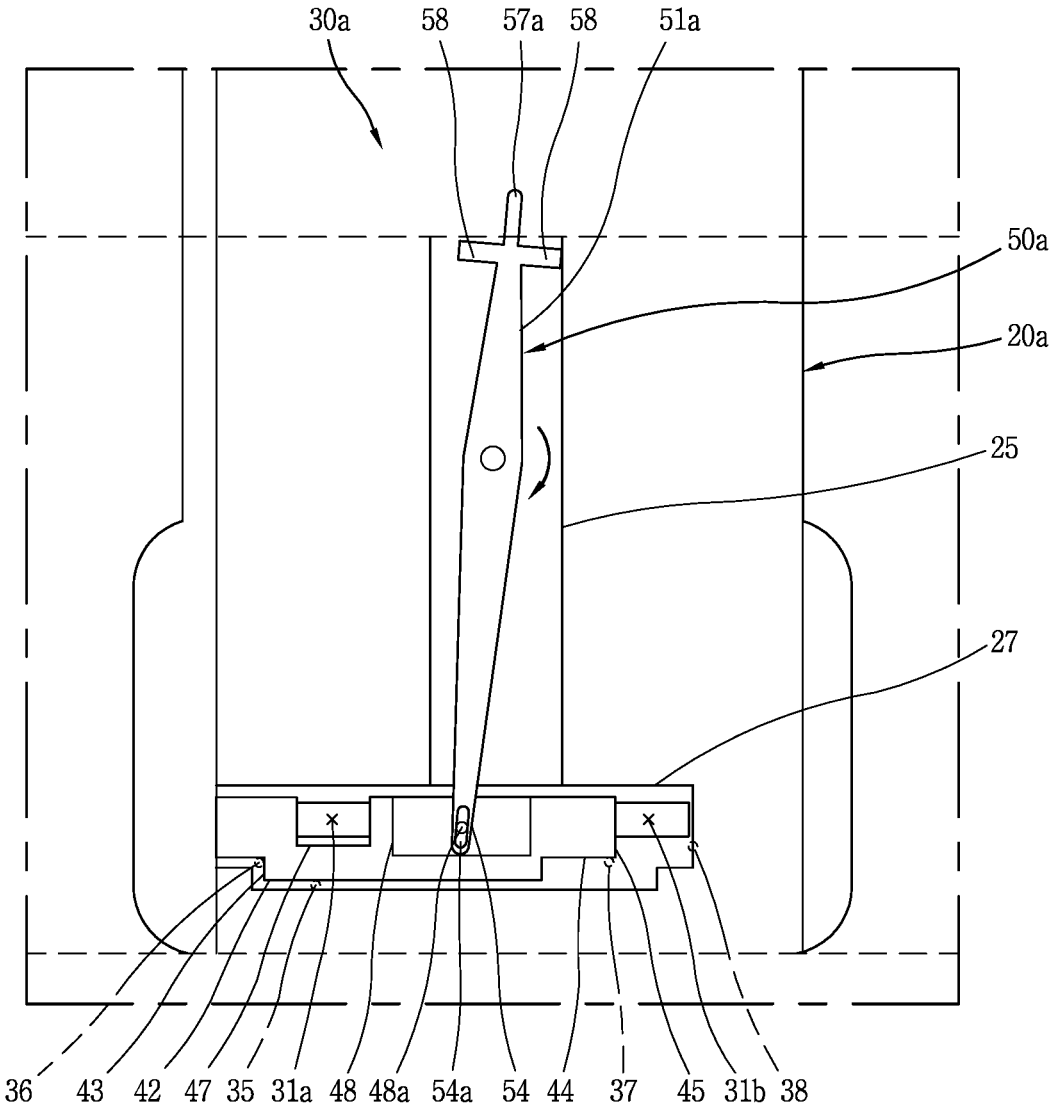
FIG. 6C is a conceptual view illustrating an operation that the cold air discharge opening is fully open by the knob link according to the first embodiment of the present disclosure.

The movement limit protrusions 58, as illustrated in FIGS. 6A, 6B, and 6C to be explained below, limit a reciprocally-rotated distance of the link body 51*a*. A length of each of the movement limit protrusions 58 is preferably determined by considering the reciprocally-moved distance of the shutter 40 and the left to light width of the cold air discharge opening 31.

The pressing portion 54 may be provided at one end portion of the link body 51*a* to be accommodated in a part of the shutter 40. FIG. 4 illustrates an example in which the pressing portion 54 is formed at a lower end portion of the link body 51*a*. The pressing portion 54 may be provided with a slot 54*a*. A boss 48*a* which is formed in an accommodating portion of the shutter 40 to be explained below may be inserted into the slot 54*a*. Accordingly, the boss 48*a* may be pressed and moved within the slot 54*a*, in response to the rotation of the link body 51*a*, to enable the reciprocal movement of the shutter 40.

The knob 57*a* may be formed on the link body 51*a* at the opposite end portion as the pressing portion 54, and as will be described below, externally exposed through a part of the control case 30*a*.

Figure 5:
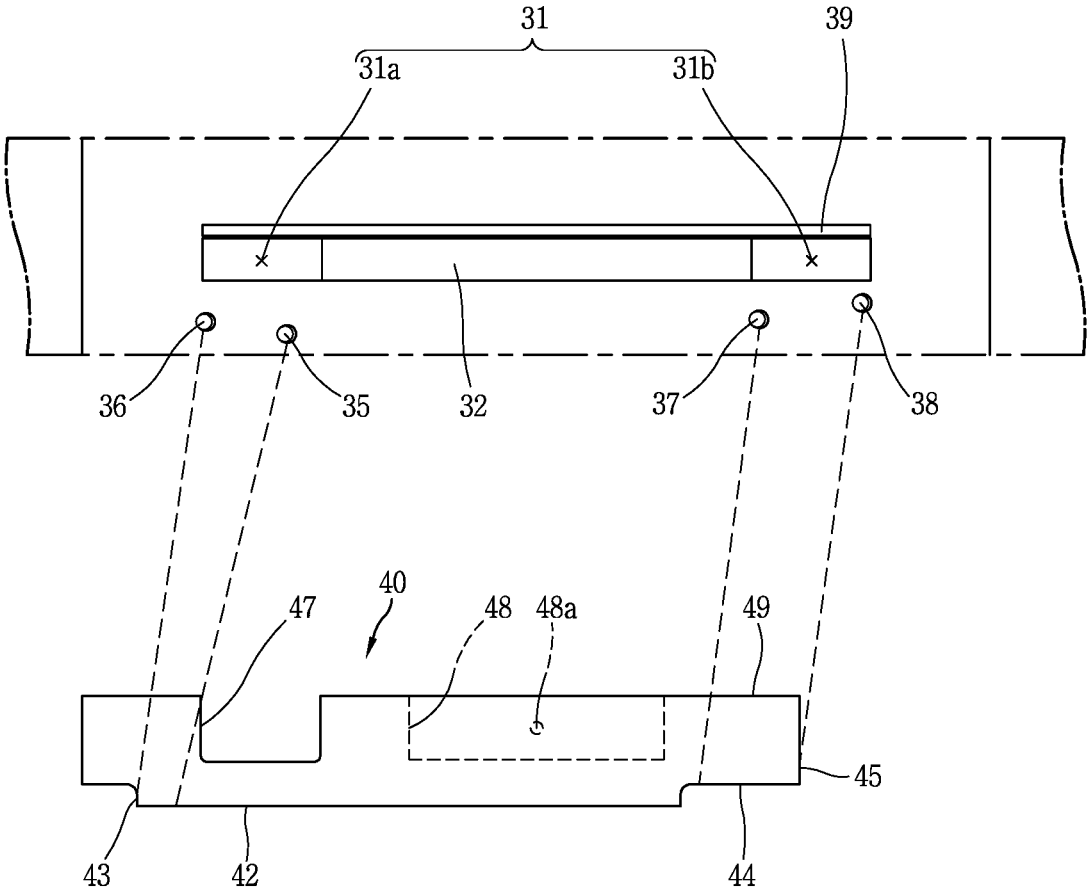
FIG. 5 is a conceptual view illustrating a coupling relationship between a cold air discharge opening and a shutter in accordance with the present disclosure.

FIG. 5 is a conceptual view illustrating a coupling relationship between the cold air discharge opening 31 and the shutter 40 in accordance with an embodiment of the present disclosure. Hereinafter, the structure of the shutter 40 and the coupling relationship between the shutter 40 and the control case 30*a* near the cold air discharge opening 31 are described with reference to FIG. 5.

The shutter 40, as illustrated in FIG. 5, opens and closes at least part of the cold air discharge opening 31. The shutter 40 may be disposed between the cold air passage duct 20*a* and the control case 30*a*, and installed on the control case 30*a* to be reciprocally movable in one direction.

The shutter 40 may include first, second, third, and fourth movement limit end portions 42, 43, 44, 45, a communicating portion 47, and an accommodating portion 49.

Meanwhile, hereinafter, moving directions (up, down, left, right) of the shutter 40 are defined based on a direction viewed from a front side as illustrated in FIG. 4.

The first movement limit end portion 42 may be provided at a lower end of the shutter 40 and brought into contact with a first protruding portion 35 to be explained below, so as to limit a downward movement of the shutter and guide a lateral movement of the shutter 40. For example, the first movement limit end portion 42 may be formed at a lower end of the shutter 40 located at a lower side of the communicating portion 47.

The second movement limit end portion 43 may be stopped by a second protruding portion 36 (explained in more detail below) so as to limit a movement of the shutter 40 in one side direction. The second movement limit end portion 43 may be formed by cutting off a lower end portion of one side of the shutter 40 in a manner of being connected to the first movement limit end portion 42. FIG. 5 illustrates one example in which the second movement limit end portion 43 is formed by cutting off an edge portion of a left lower end of the shutter 40, and stopped by the second protruding portion 36 to limit a left movement of the shutter 40.

The third movement limit end portion 44 may be formed by cutting off a lower end portion of another side of the shutter 40. The third movement limit end portion 44 may be stopped by a third protruding portion 37 (explained in more detail below) so as to limit a downward movement of the shutter 40 and guide a lateral movement of the shutter 40. FIG. 5 illustrates an example in which the third movement limit end portion 44 is formed by cutting off a lower end portion of a right side of the shutter 40.

The fourth movement limit end portion 45 may be connected to the third movement limit end portion 44. The fourth movement limit end portion 45 may be stopped by a fourth protruding portion 38 to limit a movement of the shutter 40 in another one side direction. FIG. 5 illustrates an example in which the fourth movement limit end portion 45 is an end portion corresponding to the right side of the shutter 40.

The fifth movement limit end portion 49 may be provided at an upper end portion of the shutter 40. The fifth movement limit end portion 49 may be understood as an upper end of the shutter 40 connected to the accommodating portion 47. The fifth movement limit end portion 49 may be in contact with a limit rib 39 formed t an upper portion of the cold air discharge opening 31 to limit an upward movement of the shutter 40 and guide a lateral movement of the shutter 40.

The communicating portion 47 may open at least part of one side of the cold air discharge opening 31 to discharge cold air. The communicating portion 47 may be formed by cutting off at least part of an upper portion of the shutter 40 to communicate with the cold air discharge opening 31. The communicating portion 47 does not communicate with the cold air discharge opening 31 in a closed state of the cold air discharge opening 31, and communicates with at least part of the cold air discharge opening 31 in an open state of the cold air discharge opening 31.

The shutter 40 may include an accommodating portion 48 for accommodating the pressing portion 54. The accommodating portion 48 may be bent at both sides to form a step in a thickness direction of the shutter 40. The boss 48*a* which protrudes in an arrangement direction of the control case 30*a* may be formed on one surface of the accommodating portion 48 of the shutter 40.

Hereinafter, the structure of the control case 30*a* and a connection relationship between the control case 30*a* and the shutter 40 are described.

The control case 30*a* may include first and second protruding portions 35 and 36. The first protruding portion 35 may protrude from a left lower side of the cold air discharge opening 31 toward the cold air passage duct 20*a*, and contact the lower end of the shutter 40 to limit a downward movement of the shutter 40 and guide a lateral movement of the shutter 40.

The second protruding portion 36 may protrude toward the cold air passage duct 20*a* and be spaced apart from the first protruding portion 35 to limit the lateral movement of the shutter 40. For example, as illustrated in FIG. 5, the second protruding portion 36 may be disposed at a left side of the first protruding portion 35 stopped by the second movement limit end portion 43 to limit a left movement of the shutter 40.

The control case 30*a* may further include third and fourth protruding portions 37 and 38, such as illustrated in FIG. 5.

The third protruding portion 37 may protrude from a right lower side of the cold air discharge opening 31 toward the cold air passage duct 20*a*. The third protruding portion 37 contacts the third movement limit end portion 44 to limit the downward movement of the shutter 40 and guide the lateral movement of the shutter 40.

The fourth protruding portion 38 may be disposed at a right side of the third protruding portion 37 in a spaced manner to limit the lateral movement of the shutter 40, and protrudes toward the cold air passage duct 20*a*. The fourth protruding portion 38 may be stopped by the fourth movement limit end portion 45 to limit a right movement of the shutter 40.

As illustrated in FIG. 5, the control case 30*a* may include a dividing portion 32. The dividing portion 32 may divide the cold air discharge opening 31 into two sides. The dividing portion 32 may be formed between the both sides of the cold air discharge opening 31 in a manner of extending from upper to lower ends of the cold air discharge opening 31. The cold air discharge opening 31 may be formed at each of both sides (e.g., opposite sides) of the knob coupling portion 32. Referring to FIG. 5, the cold air discharge opening 31 formed at the left side of the control case 30*a* may be referred to as a first cold air discharge opening 31*a*, and the cold air discharge opening 31 formed at the right side of the control case 30*a* may be referred to as a second cold air discharge opening 31*b*.

Regarding the first and second cold air discharge openings 31*a* and 31*b*, in a state in which the shutter 40 reciprocally moves between the control case 30*a* and the cold air passage duct 20*a*, the first cold air discharge opening 31*a* may communicate with the communicating portion 47 of the shutter 40 so as to be open. In this instance, the fourth movement limit end portion 45 may open the second cold air discharge opening 31*b*. As such, the first and second cold air discharge openings 31*a* and 31*b* may be opening and closing at the same time in response to the reciprocal movement of the shutter 40.

The first and second cold air discharge openings 31*a* and 31*b* may be opened in a manner of always having the same area. More specifically, a width of the first cold air discharge opening 31*a* in a left and right direction may be the same as a width of the communicating portion 47 in the left and right direction. Also, a distance from one end of the communicating portion 47 to the fourth movement limit end portion 45 may be the same as a distance from left to right ends of the knob dividing portion 32 disposed between the first and second cold air discharge openings 31*a* and 31*b*.

The cold air discharge opening 31 may be formed by dividing both sides thereof into the first and second cold air discharge openings 31*a* and 31*b*. The first and second cold air discharge openings 31*a* and 31*b* may always have the same area in the open state of the shutter 40. Such structure may prevent more cold air from being supplied through one side of the cold air discharge opening 31, and allow the cold air to be uniformly supplied into the refrigerating chamber 11.

A limit rib 39 to limit an upward movement of the shutter 40 may protrude from an upper portion of the cold air discharge opening 31. The limit rib 39 may be brought into contact with the fifth movement limit end portion 49 located on the upper portion of the shutter 40, to limit the upward movement of the shutter 40 and guide the lateral movement of the shutter 40.

FIG. 6A is a conceptual view illustrating an operation that the cold air discharge opening 31 is closed by the knob link 50*a* according to the first embodiment of the present disclosure. FIG. 6B is a conceptual view illustrating an operation that the cold air discharge opening 31 is open by half by the knob link 50*a* according to the first embodiment of the present disclosure. FIG. 6C is a conceptual view illustrating an operation that the cold air discharge opening 31 is open completely by the knob link 50*a* according to the first embodiment of the present disclosure.

FIGS. 6A, 6B, and 6C illustrate that the control case is shown transparent to enable a visual check of operations of the knob link 50*a* and the shutter 40. However, the embodiment of the present invention may not be limited to such transparent control case. For example, the control case 30*a* may be opaque.

Referring to FIGS. 6A, 6B, and 6C, the cold air discharge opening 31 of the control case 30*a* is opened and closed by the operation of the knob link 50*a* according to the first embodiment. Hereinafter, operations of the knob link 50*a* and the shutter 40 connected to the knob link 50*a* are described.

Referring to FIG. 6A, in a completely closed state of the cold air discharge opening 31 by the shutter 40, the knob 57*a* is disposed at a left side of the cut portion 34*a* and the pressing portion 54 of the knob link 50*a* is disposed at a right side. In this state, the shutter 40 is located such that the fourth movement limit end portion 45 is disposed at the rightmost side of the shutter accommodating portion 27 to close the second cold air discharge opening 31*b*. Also, the first cold air discharge opening 31*a* may be closed by a portion of the shutter 40 disposed at the left side of the communicating portion 47. The left movement limit protrusion 58 may be brought into contact with the left side of the link accommodating portion 25 to limit leftward rotation of the link body 51*a*.

Referring to FIG. 6B, when the knob 57*a* is disposed at a middle of the cut portion 34*a* by a user's manipulation, the link body 51*a* is rotated centering on the rotation shaft 52 by a preset angle. The shutter is moved such that the fourth movement limit end portion 45 opens a half area of the second cold air discharge opening 31*b*. In this state, the shutter 40 may be located such that the first cold air discharge opening 31*a* can be open by the communicating portion 47 by a half area.

Referring to FIG. 6C, when the knob 57*a* is disposed at the right side of the cut portion 34*a* by the user's manipulation, the link body 51*a* is rotated centering on the rotation shaft 52 by a preset angle, and the shutter 40 is moved such that the fourth movement limit end portion 45 can open an entire area of the second cold air discharge opening 31*b*. In this state, the shutter 40 may be moved and positioned such that the first cold air discharge opening 31*a* is open to entirely communicate with the communicating portion 47. The right movement limit protrusion 58 may be brought into contact with the right end of the link accommodating portion 25 to limit rightward rotation of the link body 51*a*.

FIG. 7 is a disassembled perspective view illustrating a cold air flow rate adjustment structure, including a structure of a knob link 50*b* in accordance with a second embodiment of the present disclosure. FIG. 8 is an enlarged perspective view of part A of FIG. 7.

Hereinafter, the structure of the knob link 50*b* according to the second embodiment is described.

As aforementioned, the knob link 50*b* may be rotatably coupled to the cold air passage duct 20*a* to press against the shutter 40 such that the shutter 40 is reciprocally movable. The knob link 50*b* may include a link body 51*b*, a pressing portion, and a knob 57*b*.

The link body 51*b* may be provided with the rotation shaft 52, and connected to a cold air passage duct 20*b* to be reciprocally rotatable by a predetermined distance centering on the rotation shaft 52. The pressing portion 54 may be provided at one end portion of the link body 51*b*, and the knob 57*b* may be provided at an end portion opposite to the one end portion.

The link body 51*b* may be disposed in a space of at least part of the cold air passage duct 20*b* in a manner of extending with intersecting with one direction that the shutter 40 reciprocally moves. Referring to FIG. 7, the link body 51*b* may be disposed in an upward and downward direction relative to the ground surface. As the link body 51*b* reciprocally rotates centering on the rotation shaft 52, the shutter 40 reciprocally moves in a left and right direction.

The link body 51*b* may be formed with a width decreasing (e.g., narrowing) from a portion near the rotation shaft 52 to both end portions. For example, as illustrated in FIG. 7, the link body 51*b* may be formed in a shape of a diamond toward a lower side. This structure increases a rotating distance of the link body 151*b* that rotates centering on the rotation shaft 52 and thus is more advantageous in the reciprocal movement of the shutter 40. The link body 51*b* according to the second embodiment may be bent two times at the upper portion of the link body 51*b* to be disposed between the control case 30*b* and the link accommodating portion 25 of the cold air passage duct 20*b*. Referring to FIG. 7, one example of the link body 51*b* that two "L" shapes disposed to face each other at 180° are coupled to each other.

A slot 53 (see e.g., FIG. 8) may be formed through an upper end portion of the link body 51*b* according to the second embodiment.

Unlike the knob 57*a* of the first embodiment which protrudes from the upper side of the link body 51*b*, the knob 57*b* according to the second embodiment may be coupled to the upper side of the link body 51*b*, as a separate component.

Figure 8:
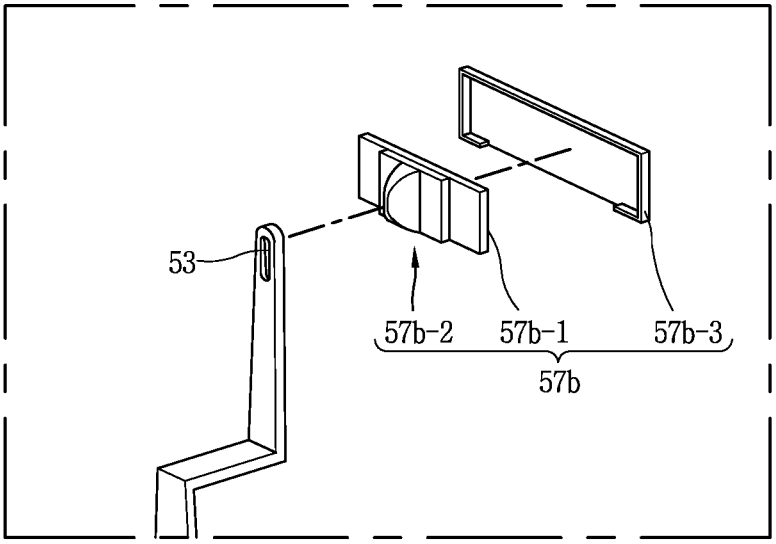
FIG. 8 is an enlarged perspective view of part A of FIG. 7.

The knob 57*b* in the second embodiment may include a sliding plate 57*b*-1 and a knob handle 57*b*-2 as illustrated in FIG. 8.

The sliding plate 57*b*-1 may be slidably installed at the cut window 34*b*. The sliding plate 57*b*-1 may thus support the knob handle 57*b*-2 to enable a left and right movement of the knob handle 57*b*-2 and allow the rotation of the link body 51*b*. The sliding plate 57*b*-1 may be brought into contact with left and right sides of the cut window 34*b*, so as to limit a left and right movement of the knob handle 57*b*-2.

The knob handle 57*b*-2 may protrude from the sliding plate 57*b*-1. Referring to FIG. 8, the knob handle 57*b*-2 may extend in an up and down direction into a shape facilitating the user to manipulate it. The link body 51*b* rotates by a predetermined distance in response to a left and right movement of the knob handle 57*b*-2. One example in which the knob handle 57*b*-2 is inserted into the slot 53 of the link body 51*b* and protrudes forwardly to enable the user's manipulation is illustrated in FIG. 8.

The knob 57*b* may further include a knob cover 57*b*-3. The knob cover 57*b*-3 may be coupled to a cover accommodating portion 29 of the cold air passage duct 20*b*. The knob cover 57*b*-3 may be formed to have a wider area in the left and right directions than the sliding plate 57*b*-1 such that the sliding plate 57*b*-1 can be slid in the left and right directions.

As aforementioned, the cut window 34*b* through which the knob handle 57*b*-2 is exposed to allow the manipulation of the knob link 50*b* according to the second embodiment may be formed at one surface of the control case 30*b*. For example, the cut window 34*b* may be formed above the bent surface and be spaced apart from the bent surface by a predetermined distance. For example, the cut window 34*b* may be formed in a rectangular shape to allow the left and right manipulation of the knob handle 57*b*-2, such as illustrated in FIG. 7.

As aforementioned, the link accommodating portion 25 may be formed at the cold air passage duct 20*b*. The link accommodating portion 25 may extend up to a position corresponding to a lower end of the cut window 34*b*, so as to accommodate the knob link 50*b*. The cover accommodating portion 29 for accommodating the knob cover 57*b*-3 may be provided at one surface of the cold air passage duct 20*b* that faces the cut window 34*b*.

The pressing portion 54 may be provided at one end portion of the link body 51*b* to be accommodated in a part of the shutter 40, to allow the shutter 40 to be reciprocally movable in one direction. FIG. 7 illustrates one example in which the pressing portion 54 is formed at a lower end portion of the link body 51*b*. As illustrated, a slot 54*a* may be formed through the pressing portion 54, and a boss 48*a* formed on the accommodating portion 48 of the shutter 40 may be inserted into the slot 54*a*. The boss 48*a* is accordingly pressed in response to the rotation of the link body 51*b* and moved within the slot 54*a* so as to enable the reciprocal movement of the shutter 40.

Figure 9A:
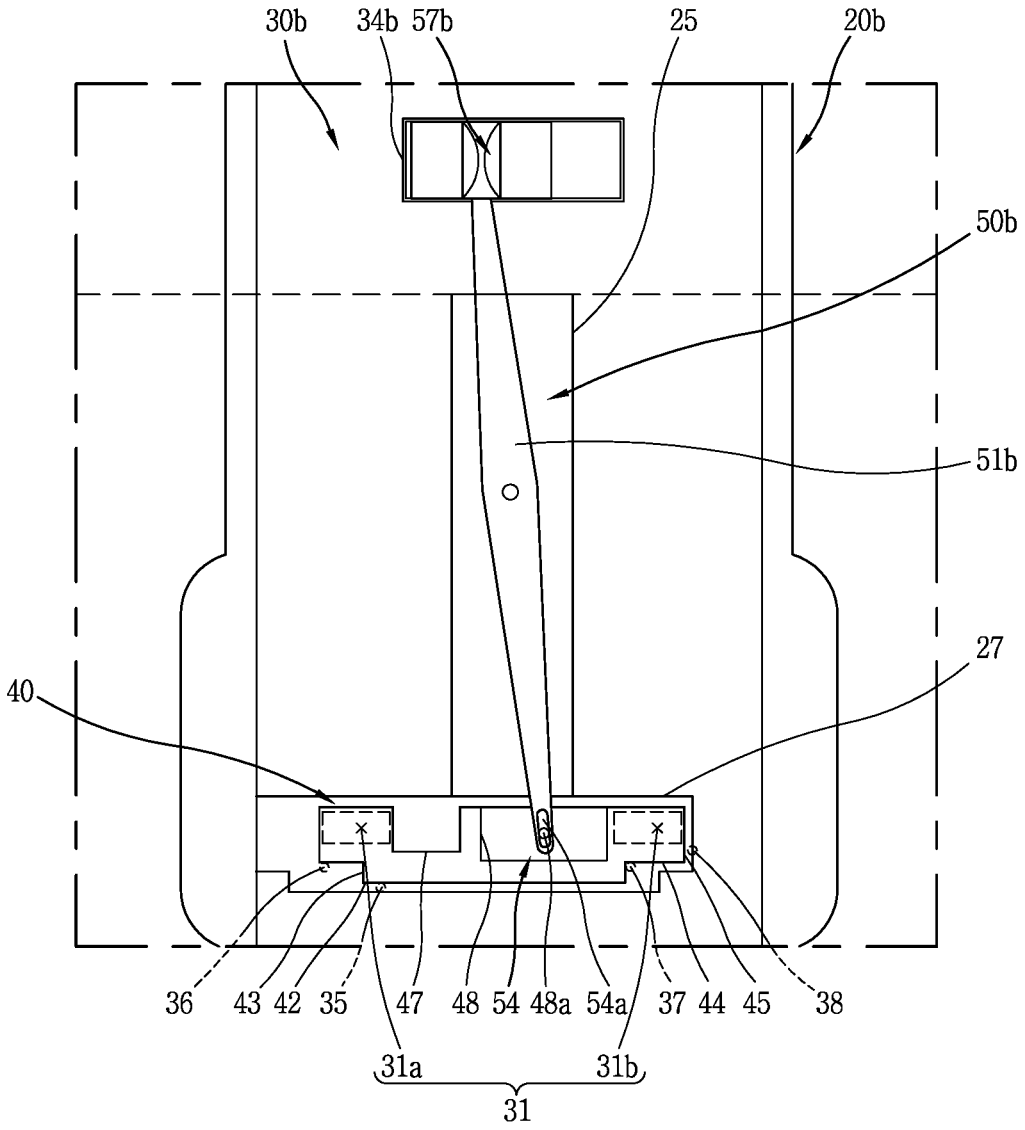
FIG. 9A is a conceptual view illustrating an operation that the cold air discharge opening is closed by the knob link according to the second embodiment of the present disclosure.
Figure 9B:
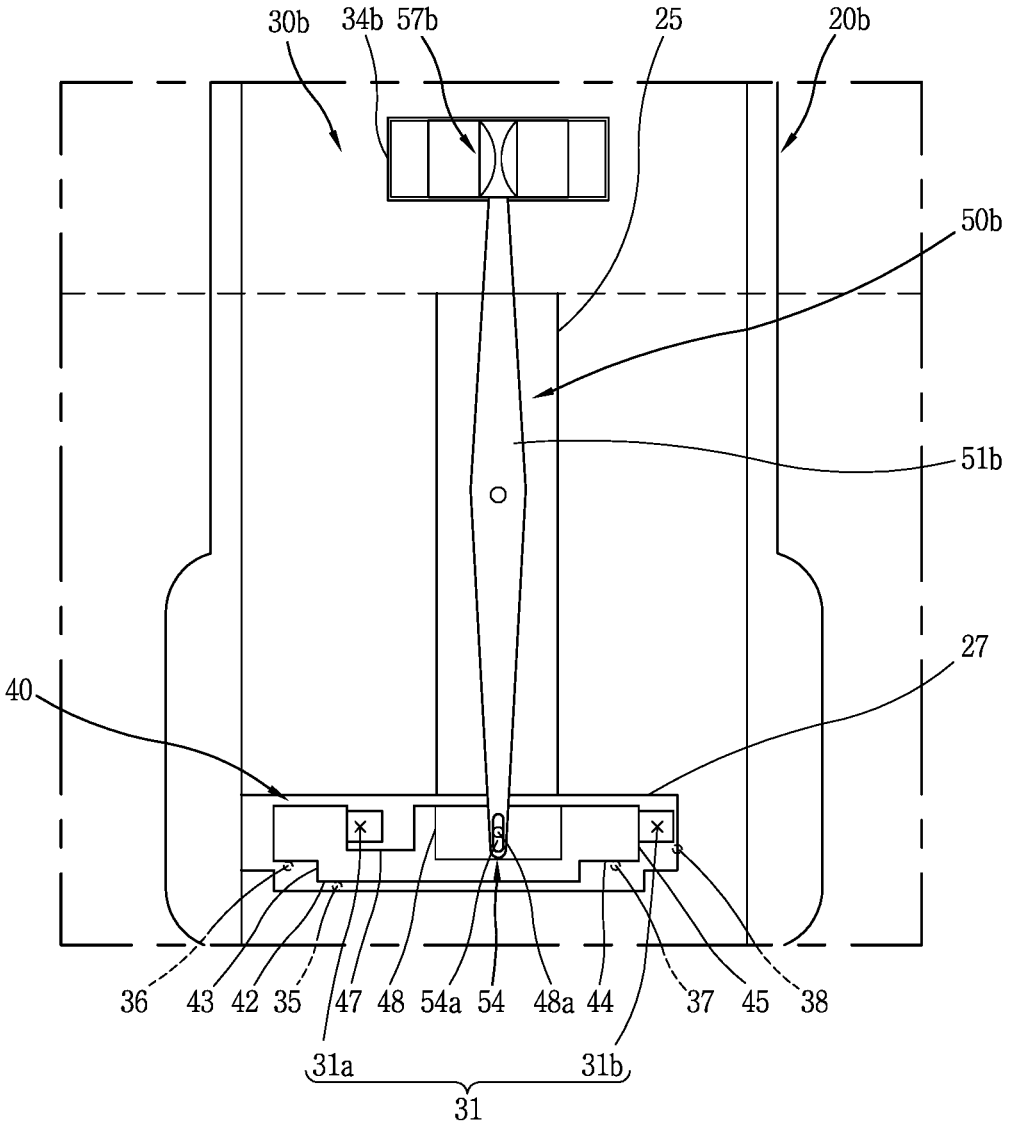
FIG. 9B is a conceptual view illustrating an operation that the cold air discharge opening is open by half by the knob link according to the second embodiment of the present disclosure.
Figure 9C:
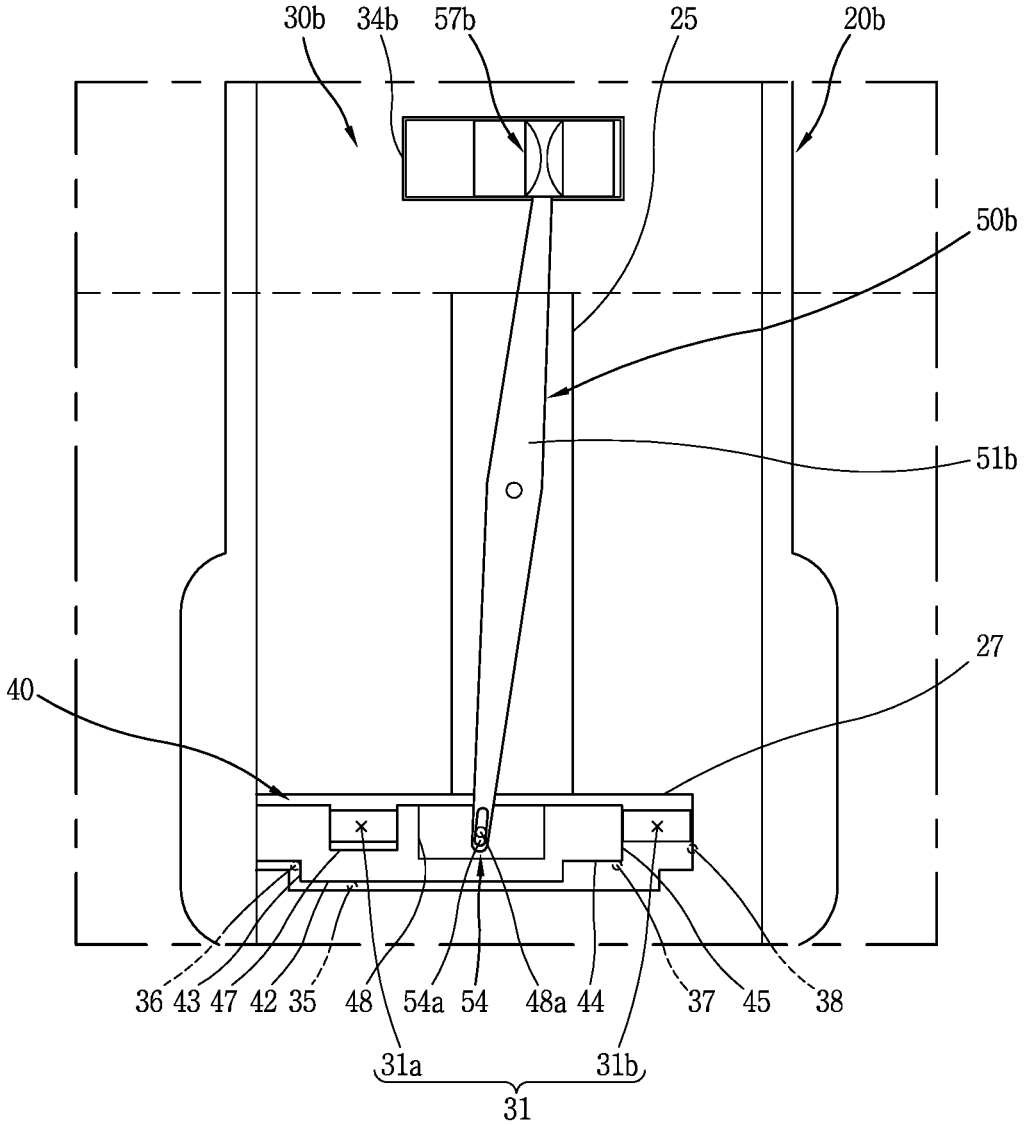
FIG. 9C is a conceptual view illustrating an operation that the cold air discharge opening is fully open by the knob link according to the second embodiment of the present disclosure.

FIG. 9A is a conceptual view illustrating an operation that the cold air discharge opening 31 is closed by the knob link 50*b* according to the second embodiment of the present disclosure. FIG. 9B is a conceptual view illustrating an operation that the cold air discharge opening 31 is open by half by the knob link 50*b* according to the second embodiment of the present disclosure. FIG. 9C is a conceptual view illustrating an operation that the cold air discharge opening 31 is open completely by the knob link 50*b* according to the second embodiment of the present disclosure.

Hereinafter, an operation of opening the cold air discharge opening 31*b* y manipulating the knob 57*b* is described with reference to FIGS. 9A, 9B, and 9C.

Referring to FIG. 9A, in a state that the cold air discharge opening 31 is completely closed by the shutter 40, the sliding plate 57*b*-1 of the knob 57*b* may be disposed at a left side of the cut window 34*b* and the pressing portion 54 of the knob link 50*b* may be disposed at a right side of the cut window 34*b*. In this state, for example, the shutter 40 may be located such that the fourth movement limit end portion 45 of the shutter 40 is arranged at the rightmost end of the shutter accommodating portion 27 to close the second cold air discharge opening 31*b*. In this state, the first cold air discharge opening 31*a* may be closed by a portion of the shutter 40 which is disposed at the left side of the communicating portion 47. Unlike the knob link 50*b* of the first embodiment in which the left movement thereof is limited by the left movement limit protrusion 58, the sliding plate 57*b*-1 is brought into contact with the left side of the cut window 34*b* and limits left movement of the knob link 50*b*.

Referring to FIG. 9B, when the knob 57*b* is disposed at a middle of the cut window 34*b* by a user's manipulation, the link body 51*b* may be rotated by a preset angle centering on the rotation shaft 52, and the shutter 40 is moved such that the fourth movement limit end portion 45 opens a half area of the second cold air discharge opening 31*b*. In this state, for example, the shutter 40 may be located to open the half area of the first cold air discharge opening 31*a* by the communicating portion 47. Both sides of the sliding plate 57*b*-1 are disposed at both sides of the cut window 34*b* and spaced apart from each other.

Referring to FIG. 9C, when the knob 57*b* is disposed at a right side of the cut window 34*b* by the user's manipulation, the link body 51*b* may be rotated by a preset angle centering on the rotation shaft 52 and the shutter 40 is moved such that the fourth movement limit end portion 45 opens an entire area of the second cold air discharge opening 31*b*. In this state, for example, the shutter 40 may be moved and located to communicate the entire area of the first cold air discharge opening 31*a* with the communicating portion 47. Unlike the knob link 50*a* of the first embodiment in which the right movement thereof is limited by the right movement limit protrusion 58, the sliding plate 57*b*-1 is brought into contact with the right side of the cut window 34*b*, and limits the right movement of the knob link 50*b*.

Thus, as described, in the refrigerator according to the present disclosure, in replacement of a damper which is controlled electrically, a reciprocally movable shutter may be provided between the control case and the cold air passage duct and a knob link may be rotatably connected to the shutter to press the shutter, thereby facilitating a manual manipulation of the knob. This may result in reducing power consumption and material costs and implementing user-desired temperature.

Also, as described, in the refrigerator according to the present disclosure, both sides of the cold air discharge opening which are adjacent to the dividing portion may always have the same area in an open state of the shutter, thereby allowing cold air to be uniformly supplied into the refrigerating chamber through the both sides of the cold air discharge opening.

Moreover, as described, in the refrigerator according to the present invention, a cold air flow rate adjustment structure, in which the knob is located at a position higher than a chiller chamber and a vegetable chamber and thus can adjust an opening and closing amount of the cold air discharge opening even without detaching a drawer, can be provided by use of a knob link structure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body having a refrigerating chamber therein;

a cold air passage duct disposed within the main body, the cold air passage duct including a cold air passage to discharge cold air into the refrigerating chamber;

a control case attached at one surface of the cold air discharge duct, the control case including a cold air discharge opening through which the cold air is discharged;

a shutter provided between the cold air passage duct and the control case, the shutter being reciprocally movable in one direction to open and close at least a part of the cold air discharge opening; and a knob link rotatably connected to the cold air passage duct to press against the shutter such that the shutter is reciprocally movable, wherein the knob link comprises:

a link body having a rotation shaft, the link body being connected to the cold air passage duct by the rotation shaft to be reciprocally rotatable by a predetermined distance, a pressing portion provided at a first end portion of the link body that is accommodated in a part of the shutter, the pressing portion to press against the shutter to be reciprocally movable in the one direction, and a knob formed on a second end portion of the link body opposite to the first end portion, whereby at least a portion of the knob is externally exposed through the control case to be manipulated by a user, and wherein the knob link comprises a plurality of movement limit protrusions formed on and integral with an upper portion of the link body to limit the movement of the knob link, the movement limit protrusions protruding from a second end portion of the link body opposite to the pressing portion in an intersecting direction with the protruding direction of the knob, and wherein the link body is at least partly disposed inside the cold air passage duct, whereby the link body extends in a direction that intersects with the one direction that the shutter reciprocally moves.

2. The refrigerator of claim 1, wherein the cold air passage duct comprises a dividing portion that divides the cold air discharge opening into a first and a second cold air discharge opening, the dividing portion extends from upper to lower portions of the cold air discharge opening between the first and second cold air discharge openings, and wherein the shutter comprises a communicating portion, the communicating portion being a cut-off portion formed at an upper side of the shutter in communication with the cold air discharge opening such that at least part of one of the first and second cold air discharge openings are open to discharge cold air.

3. The refrigerator of claim 2, wherein the first and second cold air discharge openings have the same area in a state of being opened and closed by the shutter thereby allowing cold air to be uniformly supplied into the refrigerating chamber through the first and second cold air discharge openings.

4. The refrigerator of claim 1, wherein the control case is provided with a bent control case surface that is bent in a first direction above the cold air discharge opening and bent in a second direction different from the first direction, the second direction being in parallel to the ground surface, and wherein the cold air passage duct is provided with a bent control air passage duct surface that is bent in two directions above the cold air discharge opening to correspond to a shape of the control case.

5. The refrigerator of claim 4, wherein the bent control case surface is provided with a cut-out portion, and wherein the knob protrudes from a first end of the link body and is inserted through the cut-out portion.

6. The refrigerator of claim 1, wherein the link body is bent in two directions to correspond to the shape of the control case.

7. The refrigerator of claim 6, wherein a cut window is formed at one surface of the control case located above the bent control case surface, and at least a portion of the knob is externally exposed through the cut window.

8. The refrigerator of claim 7, wherein a first end portion of the link body comprises a slot extending in an upward and downward direction relative to the ground surface, and wherein the knob comprises:

a sliding plate slidably coupled to the cold air passage duct, and a knob handle protruding from the sliding plate and inserted into the slot, whereby at least a portion of the knob handle is externally exposed through the cut window.

9. The refrigerator of claim 1, wherein the cold air passage duct comprises a dividing portion that divides the cold air discharge opening into a first side and a second side, the dividing portion extends from upper to lower portions of the cold air discharge opening between the first and second sides of the cold air discharge opening, wherein the shutter comprises a communicating portion, the communicating portion being a cut-off portion formed at an upper side of the shutter in communication with the cold air discharge opening such that at least part of one of the first and second sides of the cold air discharge opening is open to discharge cold air, and wherein the first and second sides of the cold air discharge opening each discharge the cold air therethrough such that the first side of the cold air discharge opening is open while the second side of the cold air discharge opening is open in response to at least part of the second side of the cold air discharge opening being in communication with the communicating portion.

10. The refrigerator of claim 1, wherein the shutter comprises an accommodating portion to accommodate the pressing portion therein, the accommodating portion having both sides bent that form a step in a thickness direction of the shutter, wherein a boss protruding toward the control case is formed at one surface of the accommodating portion, wherein the pressing portion includes a slot to receive the boss, whereby the pressing portion pushes against the boss within the slot in response to a rotation of the link body such that the shutter is reciprocally moved in the one direction while the knob link is rotated.

11. The refrigerator of claim 1, wherein the link body is shaped having a width that decreases in a direction toward both end portions of the link body near the rotation shaft and rotates to enable the reciprocal movement of the shutter.

12. The refrigerator of claim 1, wherein the link body is formed in a shape of a diamond extending toward the first end of the link body to increase a rotating distance of the link body.

13. A refrigerator comprising:

a main body having a refrigerating chamber therein;

a cold air passage duct disposed within the main body, the cold air passage duct including a cold air passage to discharge cold air into the refrigerating chamber;

a control case attached at one surface of the cold air discharge duct, the control case including a cold air discharge opening through which the cold air is discharged;

a shutter provided between the cold air passage duct and the control case, the shutter being reciprocally movable in one direction to open and close at least a part of the cold air discharge opening; and a knob link rotatably connected to the cold air passage duct to press against the shutter such that the shutter is reciprocally movable, wherein the knob link comprises:

a link body having a rotation shaft, the link body being connected to the cold air passage duct by the rotation shaft to be reciprocally rotatable by a predetermined distance, a pressing portion provided at a first end portion of the link body that is accommodated in a part of the shutter, the pressing portion to press against the shutter to be reciprocally movable in the one direction, and a knob formed on a second end portion of the link body opposite to the first end portion, whereby at least a portion of the knob is externally exposed through the control case to be manipulated by a user, wherein the control case comprises:

a first protruding portion provided below the cold air discharge opening and protruding from one side of the control case toward the cold air passage duct, whereby the first protruding portion contacts a lower end of the shutter to limit a downward movement of the shutter and guide a lateral movement of the shutter, a second protruding portion protruding toward the cold air passage duct and being spaced apart from the first protruding portion to limit the lateral movement of the shutter, a third protruding portion provided at another side of the control case below the cold air discharge opening and protruding toward the cold air passage duct, whereby the third protruding portion contacts at least part of the shutter to limit the downward movement and guide the lateral movement of the shutter; and a fourth protruding portion protruding toward the cold air passage duct to limit the lateral movement of the shutter, whereby the fourth protruding portion is positioned such that the third protruding portion is disposed between the first protruding portion and the fourth protruding portion.

14. The refrigerator of claim 13, wherein the shutter comprises:

a first movement limit end portion provided at the lower end portion of the shutter, whereby the first movement limit end portion contacts the first protruding portion to limit the downward movement of the shutter;

a second movement limit end portion formed at the lower end portion of one side of the shutter, whereby the second movement limit end portion is connected to the first movement limit end portion and contacts the second protruding portion to limit a movement of the shutter in one side direction;

a third movement limit end portion formed at a lower end portion of another one side of the shutter, whereby the third movement limit end portion contacts the third protruding portion to limit the downward movement of the shutter and guide the lateral movement of the shutter; and a fourth movement limit end portion provided at another one side of the shutter connected to the third movement limit end portion, the fourth movement limit end portion contacts the fourth protruding portion to limit a movement of the shutter in another one side direction.

15. The refrigerator of claim 13, wherein the link body is formed in a shape of a diamond extending toward the first end of the link body to increase a rotating distance of the link body.

* * * * *